US006619734B2

(12) United States Patent
Helmsderfer

(10) Patent No.: US 6,619,734 B2
(45) **Date of Patent: *Sep. 16, 2003**

(54) CHILD SUPPORT DEVICE WITH DISPLACEABLE SEAT ELEMENT

(76) Inventor: John A. Helmsderfer, 6909 Kenwood Rd., Cincinnati, OH (US) 45243

( * ) Notice: Subject to any disclaimer, the term of this patent is extended or adjusted under 35 U.S.C. 154(b) by 0 days.

This patent is subject to a terminal disclaimer.

(21) Appl. No.: 09/812,013

(22) Filed: Mar. 19, 2001

(65) Prior Publication Data

US 2001/0019219 A1 Sep. 6, 2001

Related U.S. Application Data

(63) Continuation-in-part of application No. 09/435,513, filed on Nov. 8, 1999, now Pat. No. 6,203,102, which is a continuation of application No. 09/025,428, filed on Feb. 18, 1998, now Pat. No. 6,074,007, application No. 09/812,013, filed on Mar. 19, 2001, which is a continuation-in-part of application No. 09/436,310, filed on Nov. 8, 1999, now Pat. No. 6,224,148, which is a continuation of application No. 09/024,699, filed on Feb. 17, 1998, now Pat. No. 6,010,184.

(51) Int. Cl.[7] ..... A47C 13/00; A47D 1/00

(52) U.S. Cl. ..... 297/130; 297/134; 297/118; 297/440.22; 297/256.16; 297/236

(58) Field of Search ..... 297/130, 134, 297/118, 440.22, 256.16, 236

(56) References Cited

U.S. PATENT DOCUMENTS

| | | | | |
|---|---|---|---|---|
| 1,267,800 | A | 5/1918 | Peterman | |
| 2,058,299 | A | 10/1936 | Cook | |
| 2,063,046 | A | 12/1936 | Naturkacz | |
| 2,244,096 | A | 6/1941 | Brazell | |
| 2,717,633 | A | 9/1955 | Hartmann | |
| 2,731,072 | A | 1/1956 | Post | |
| 3,427,069 | A | 2/1969 | McDonald | |
| 4,065,175 | A | 12/1977 | Perego | 297/130 |
| 4,743,063 | A | 5/1988 | Foster, Jr. | 297/130 |
| 4,768,827 | A | 9/1988 | Musgrove | |
| 5,248,181 | A | 9/1993 | Efthimiou | 297/130 |
| 5,421,636 | A | 6/1995 | Gamble | |
| 5,470,039 | A | 11/1995 | Hilger | |
| 5,527,096 | A | 6/1996 | Shimer | 297/327 |
| 5,564,778 | A | 10/1996 | Shimer et al. | 297/256.16 |
| D387,583 | S | 12/1997 | Shear | |

*Primary Examiner*—Anthony D. Barfield
(74) *Attorney, Agent, or Firm*—Wood, Herron & Evans, LLP

(57) ABSTRACT

A multi-purpose child support device comprises a frame having a base for placement on a floor surface and a support section positioned above said base. A seat element is configured for receiving a toddler child in a sitting position and is coupled with the support section above the floor surface for forming a high chair. The seat element is displaceably mounted to the frame and is operable for being selectively removed from the support section such that the support section receives an infant child carrier for supporting an infant child carrier above a floor surface.

7 Claims, 9 Drawing Sheets

CHILD SUPPORT DEVICE WITH DISPLACEABLE SEAT ELEMENT

RELATED APPLICATIONS

This application is a continuation-in-part of both (1) U.S. application Ser. No. 09/435,513, entitled "Child Support Device with Slidable Seat Element," and filed on Nov. 8, 1999, now U.S. Pat. No. 6,203,102, which, in turn, is a continuation of an application of the same title filed on Feb. 18, 1998, as Ser. No. 09/025,428, and is now U.S. Pat. No. 6,074,007; and (2) Ser. No. 09/436,310 entitled "Child Support Device with Removable Seat Element," filed Nov. 8, 1999, now U.S. Pat. No. 6,224,148, which, in turn, is a continuation of an application of the same title filed on Feb. 17, 1998 as Ser. No. 09/024,699, and is now U.S. Pat. No. 6,010,184. All above-referenced applications and issued patents are incorporated herein by reference in their entireties.

FIELD OF THE INVENTION

This invention relates to a child support device and specifically to a device for supporting children of different ages, such as in a restaurant atmosphere.

BACKGROUND OF THE INVENTION

When families go to a restaurant or other similar facility for dining, they often include small children. The children may be small toddlers or even smaller infants. Therefore, for a pleasurable dining experience for the entire family, and particularly the adults of the party, the small children must be properly and safely accommodated at the table.

While larger children are often able to sit in regular adult chairs, some with the aid of a traditional booster seat, the smaller toddler and infant children require special arrangements. For example, traditional high chairs have long been available for toddler children who are able to sit up on their own, but who are yet too small to sit in an adult chair, even with a booster seat. Furthermore, high chairs are particularly suitable for rambunctious toddlers for whom a certain amount of containment is desired during a meal. High chairs provide certain restraints, such as belts, for a child placed therein, and therefore, provide peace of mind for the parents or care givers during the meal. Additionally, the seating platform for the toddler child is generally smaller than in an adult chair, thereby helping the child to remain in an upright position.

While traditional high chairs have been suitable for toddler children who can sit on their own, they are entirely inadequate for infant children who do not yet have the motor skills to do so. Infants are generally brought to restaurants in an infant carrier, often referred to as a "pumpkin seat." Infant carriers usually include a cradle-shaped base for comfortably carrying or supporting the infant. A pivoting handle is attached to the base so an adult may manipulate the carrier. When dining with an infant child, parents often have to place the infant carrier and infant on the table, on a chair (if large enough) or on the floor.

All of those available options for placement of the infant carrier are undesirable. Not only is the carrier exposed to the chances of falling, but oftentimes there is not sufficient table space for placing the carrier thereon. Furthermore, a chair may be too small to accommodate the carrier. Even if the chair is large enough, the awkward and cumbersome shape of infant carriers often requires that the chair and carrier be wedged against the table to ensure that the carrier does not fall off of the chair. This can present a precarious, and therefore, dangerous situation for the infant. Finally, placing the infant and carrier on a dirty, drafty restaurant floor is certainly an option to be avoided, even though it is often the safest of the available options.

One option, but one which is dangerous and discouraged or prohibited by many restaurants, is to turn a traditional high chair structure upside-down and place the infant carrier in the wide base of the chair. In doing so, the chair rests and contacts the floor on the very narrow seat portion. Therefore, the upside-down chair is very likely to fall, which could injure a baby placed thereon. Furthermore, the restaurant could be exposed to legal liability for an injured child. While such an option is discouraged, parents will still choose to do so, and restaurants will allow them for the purposes of accommodation or lack of a more suitable option.

Attempts have also been made to develop a support device specifically for infant carriers. Many such structures are expensive and complicated and are only adapted to a specific carrier design. If a restaurant does not have a specific device for the family's infant carrier, the parents have to carry their own support device. As may be appreciated, it is very inconvenient and time-consuming to have to transport and set up such a device in a restaurant.

One type of device for supporting a variety of different infant carriers consists of a sling stretched between two support elements. The sling forms a hammock to receive the carrier. Such a device is usually suitable for the purpose of supporting the carrier above the floor, regardless of the shape of the carrier. However, such devices must be purchased and maintained by a restaurant in addition to their other separate high chair structures.

Another commercially available product purports to be suitable for both infants and toddlers. Essentially, the product is a traditional high chair which can recline for cradling an infant. However, such a product requires that the infant be removed from its carrier and placed in the plastic seat of the product. For a parent, such a scenario is not desirable. First, the plastic seat is hard and cold, and may even be dirty. Personal infant carriers usually have cushions on which the baby rests and the parents know that their carrier is clean. Therefore, the parents will be reluctant to switch the baby from their personal carrier to a public high chair device. Secondly, the infant may be nestled in blankets and other such covers, and may even be sleeping. Having to wake the infant and/or move all of the blankets to the public high chair device would further deter use of such a product. Finally, the parents or the restaurant staff are left with trying to store the bulky, empty infant carrier during the meal.

Therefore, it would seem that the only practical option is to maintain a large number of dedicated infant carrier support devices. A significant drawback, however, to any dedicated infant carrier support device, is that the restaurant must keep a number of such devices on hand, and also must obtain separate high chair structures for toddler children, and booster seats for older children. Available infant carrier support devices and high chairs are large and bulky, and therefore, require a substantial amount of floor space. While some high chair structures and infant carrier support devices are stackable, generally they are not.

Another drawback is the additional purchase and replacement costs for separate devices. However, restaurants, and particularly family-type restaurants, desire to keep their family patrons not only satisfied, but also comfortable with the thought that their children will be safe during the dining experience. Therefore, they maintain a large number of different devices to do so.

Another drawback to having a large number of dedicated support devices, is the cleaning required for such structures. Food is usually splattered all over by toddler children and may also be splattered by older infant children. Of course, parents do not want to place their child in a high chair or other device which is still dirty from the previous child. Therefore, the work loads of waitpersons, buspersons, and hosts are all increased to ensure clean high chairs and infant carrier support devices.

Therefore, it is one objective of the invention to accommodate dining families so that their children of all ages are safe and secure during the meal.

It is another objective of the invention to accommodate both toddler children and infant children during dining.

It is still another objective of the invention to reduce the costs to the restaurant owner and the reduce workloads of the staff associated with such accommodation.

It is another objective of the invention to safely provide support to a child during a meal which is above the floor and off of the table.

Still further, it is an objective to provide such accommodation in a safe manner to reduce the liability exposure of a restaurant owner.

SUMMARY OF THE INVENTION

The above-listed objectives and other objectives are addressed by the present invention which provides a multi-purpose child support device which can accommodate both a toddler child as well as an infant child who is resting in an infant carrier. The multi-purpose child support device of the present invention selectively secures the children of either toddler or infant age so that they are safe and secure during the meal. The child is supported above the floor and off of the table at a relatively low cost to the restaurant owner. Furthermore, since a single device is used for both toddler and infant children, the purchase and maintenance costs to the restaurant owner are reduced and the workloads of the various staff persons in the restaurant are also reduced. Still further, the safety of the device reduces the liability exposure of the restaurant owner.

The inventive child support device may be readily and selectively converted from a toddler mode to an infant mode and then back again. It includes a frame having a base section which is placed on a floor surface and a support section above the base section for supporting the child. In the toddler mode, a seat element is configured for receiving a toddler child in the sitting position. The seat element engages the support section of the frame above the floor surface for forming a high chair for a toddler child. Like a traditional high chair, the toddler child is maintained in a seated and upright position. The may eat at a table and interact with other children and adults sitting at the table.

The inventive child support device is selectively adaptable to the infant mode for receiving an infant child carrier when a child is too young to be able to sit up on their own in a high chair, and thus must remain resting in the infant carrier during the meal. To that end, the seat element is displaceably mounted to the frame and is operable for being selectively displaced from the support section. The support section, in turn, is configured to receive an infant carrier when the seat element is selectively displaced therefrom, and is further operable for safely supporting the infant carrier above the floor surface.

In one embodiment of the invention, the seat element may be removed from the support section and frame altogether. The support section is then configured to receive an infant carrier to support the infant carrier above a floor surface. In such an embodiment, the upper edge of the support section, and specifically, the upper edges of the vertical side members of the frame, have open portions, such as in the form of indentations formed therein, or cut-away sections. The indentations or cutaway sections are configured for receiving and containing handle portions of an infant child carrier to secure the carrier in the support section of the frame. The support section prevents the carrier from sliding therefrom. When in the infant mode, horizontal cross members engage a bottom or side surface of the infant carrier for supporting the carrier.

In one embodiment, the frame of the device is configured to engage the removed seat element to secure the displaced seat element to the frame below the support section while an infant child carrier is supported on the frame support section. The seat element is also appropriately configured for being secured to the frame when removed from the support section. In one embodiment of the invention, the seat element is horizontal and forms a shelf for child care or other items when the support section is supporting an infant carrier. In accordance with the principles of the present invention, the device may be readily and easily converted between an infant carrier support and a high chair by the restaurant staff.

In another embodiment of the invention, the seat element is pivotally mounted to the frame and is operable for being selectively pivoted away from the support section. The support section, in turn, is configured to receive an infant carrier when the seat element is pivoted away therefrom, and is further operable for safely supporting the infant carrier above the floor surface.

In one embodiment of the invention, the frame includes side members which have U-shaped portions with open upper ends for receiving the infant child carrier. As will be understood by a person of ordinary skill in the art, the portions might also be characterized as C-shaped, depending upon how much of a cut-out section is provided at the top of the frame side members. The open ended, U-shaped portions of the side members form part of the support section of the frame and provide accommodation for the handle of the infant carrier so that the infant carrier rests securely in the support section. The support section is configured for containing a handle of an infant child carrier. Preferably, the seat element is pivotally mounted to the frame to be pivoted away from the upper support section and also slid downwardly on the frame to be suspended below the support section when the infant carrier is placed therein. To convert the child support device back to a high chair, or the toddler mode, the seat element is simply pivoted and slid upwardly and back into the support section.

In another embodiment of the invention, a multi-purpose child support device includes a frame with a base section and a support section positioned above the base section. The base section is configured for positioning on a floor surface. A seat element with a seat surface and back supports a toddler child in a sitting position so that the device acts as a high chair.

The support section has an upper edge which is configured for engaging the seat element, and particularly for engaging a lower edge of the seat element to support the seat element in a first position where the device acts as a high chair. The seat element is movably mounted to the frame and is movable to a second position displaced from the support section. With the seat element in the second position, the support section is configured to receive an infant child carrier and engage the carrier to prevent it from sliding off of the frame.

Various structures might be utilized in such an embodiment for securing the seat element in the first position or high chair position. For example, a groove and track arrangement, a male/female coupling arrangement and/or a hasp structure might be utilized. Alternatively, the seat element may be pivotally coupled to the support section for being pivoted between the first and second position.

The inventive device thus provides a single child support device which safely accommodates children of all ages, including infant children within a carrier. The safety provided by the device reduces a restaurant owner's liability exposure. Restaurants only have to purchase one device to accommodate all children and thus do not have to maintain separate infant carrier support devices as well as traditional high chairs. The inventive device provides a safe and secure place for children during dining. Furthermore, the inventive device in the infant carrier form may be utilized for supporting an infant carrier while parents wait to be seated at a table. This eliminates the need for parents to hold the heavy infant carrier for a long period of time or to place the infant carrier on a cold and dirty ground surface. Still further, a substantial amount of valuable restaurant space is conserved by eliminating separate high chair and infant carrier support devices.

BRIEF DESCRIPTION OF THE DRAWINGS

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
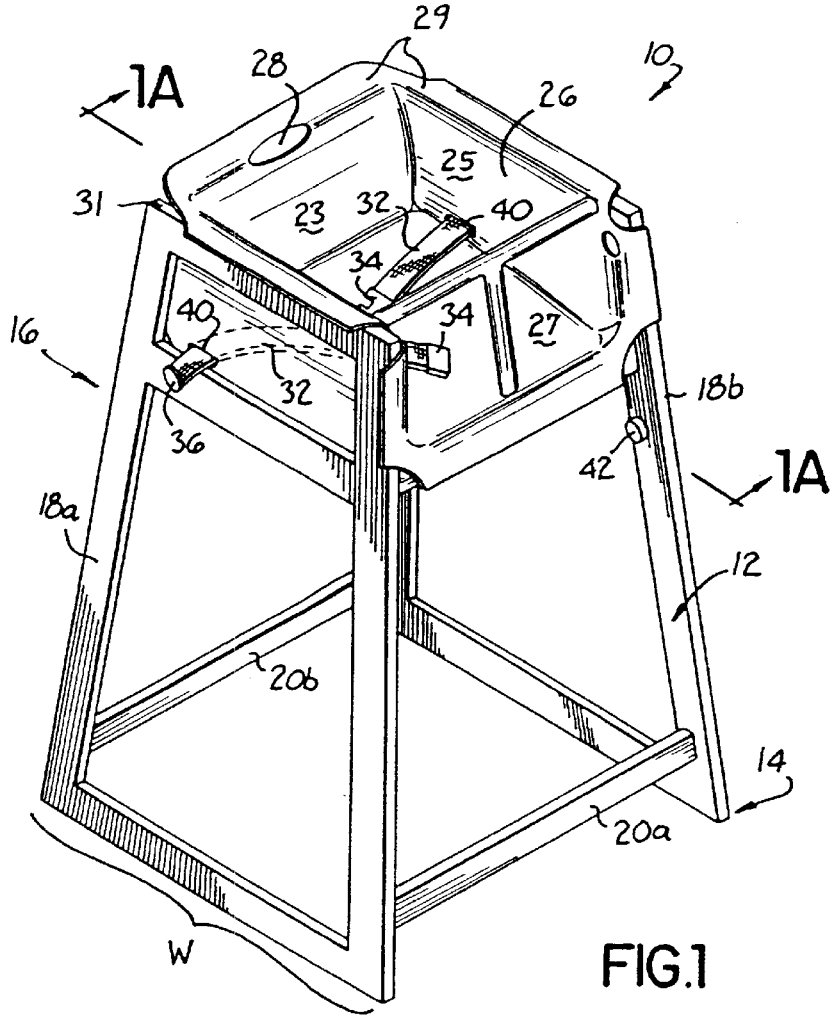
FIG. 1 is a perspective view of one embodiment of the inventive child support device.
Figure 2:
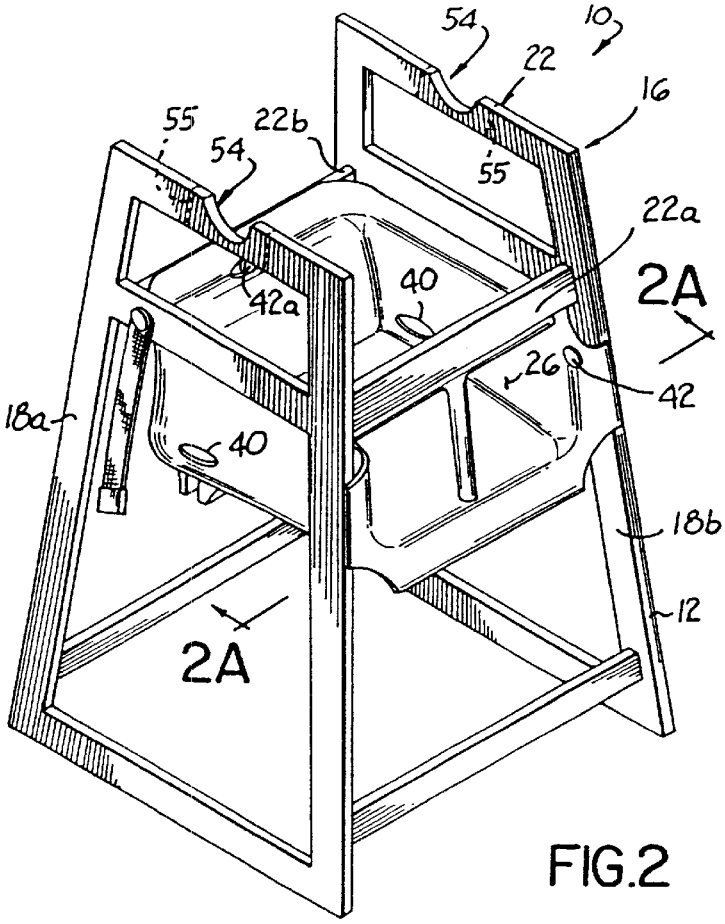
FIG. 2 is a perspective view of the inventive child support device of FIG. 1 in the infant carrier support form.
Figure 2A:
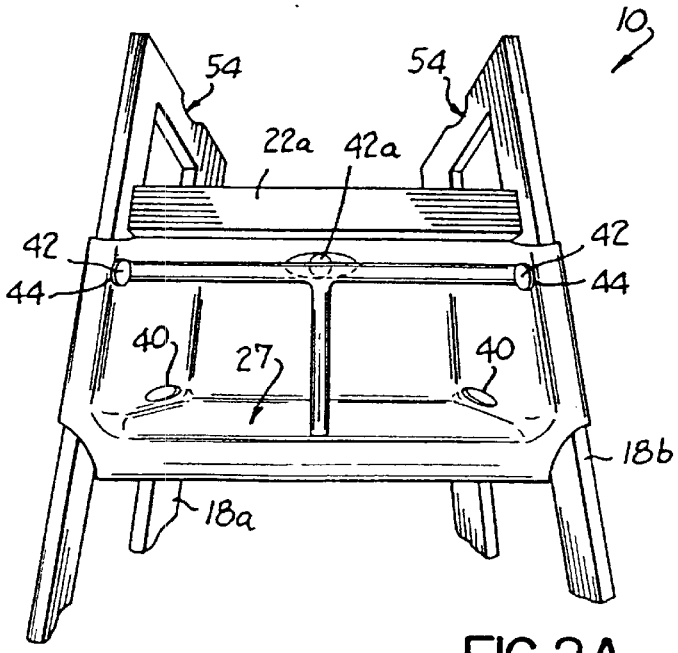
FIG. 2A is a front view of the inventive device of FIG. 2 showing the seat element of the device secured to the frame below the support section of the frame.
Figure 3:
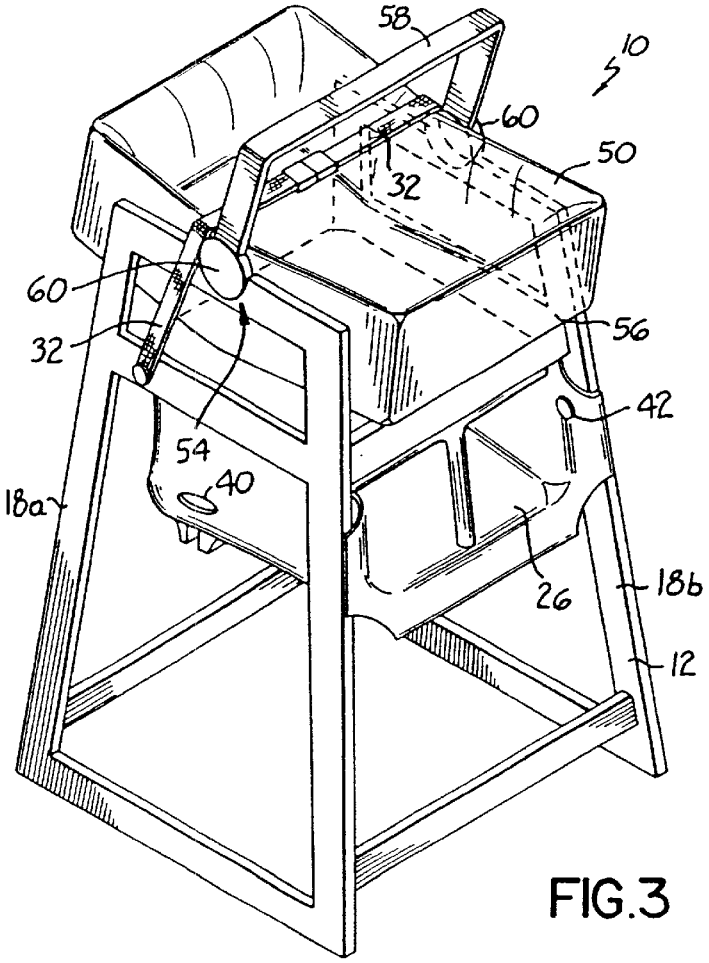
FIG. 3 is a perspective view of the inventive device shown supporting an infant carrier.

FIG. 1 shows the perspective of one embodiment of the child support device 10 of the invention in a high chair form or toddler mode. In accordance with the principles of the present invention, device 10 may also be converted to an infant carrier support form or infant mode as illustrated in FIGS. 2, 2A and 3. Device 10 includes a frame 12 which has a base 14 and a support section 16. The base is preferably formed of wood and includes two vertical side elements 18*a*, 18*b* which have a width W at the bottom thereof which is larger than the effective width of the top of the side elements so that the side elements generally have a triangular shape with a wider dimension proximate base 14 and a narrower dimension proximate support section 16 of the frame 12. In that way, the frame 12 is stably supported, such as on a floor surface. Frame 12 also includes horizontal cross members 20*a*, 20*b* proximate base 14 and additional horizontal cross-members 22*a*, 22*b* as illustrated in FIG. 1. The cross-members 22*a*, 22*b* form part of the support section 16 of frame 12 and support a seat element 26 or an infant child carrier as discussed further hereinbelow. The side elements taper inwardly in the direction of arrows 23 so that, in effect, the cross members 20*a*, 20*b* are longer than members 22*a*, 22*b*.

Figure 1A:
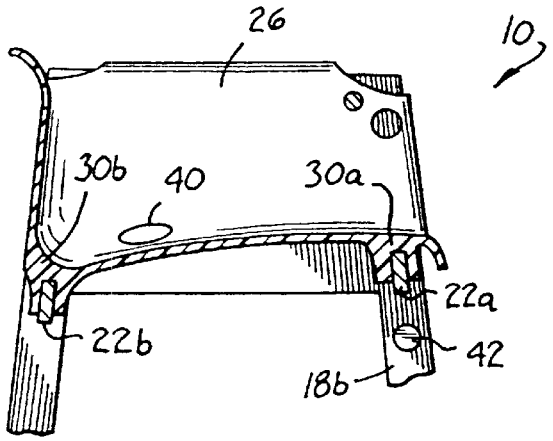
FIG. 1A is a side view of the inventive device of FIG. 1 in the high chair form.

Seat element 26, which is preferably formed of a suitable plastic material for easy cleaning, is configured for receiving a toddler child (not shown) in a sitting position. Seat element 26 engages support section 16 above a floor surface, and is supported by the support section for forming a high chair for a toddler child, as illustrated in FIGS. 1, and 1A. Seat element 26 is removably mounted to frame 12 and is operable for being selectively removed from the support section as illustrated in FIGS. 2 and 2A. The support section 16 is configured to receive an infant child carrier when the seat element is removed therefrom and is operable for supporting an infant child carrier above a floor surface, as illustrated in FIG. 3. The support section 16 of frame 12 is essentially formed by upper portions of the vertical side members 18*a*, 18*b* and the cross members 22*a*, 22*b*. Seat element 26 preferably includes a handle aperture 28 for selectively removing and replacing the seat element 26 in the support section 16.

Turning to FIG. 1A, seat element 26 includes elongated tracks 30*a*, 30*b* which preferably are integrally formed with the seat element 26 on a bottom side thereof. Of course, the tracks 30*a*, 30*b* might also be separately formed and suitably coupled to seat element 26. Tracks 30*a*, 30*b* are configured for receiving the horizontal cross members 22*a*, 22*b* respectively for securing seat element 26 to the support section 16. As illustrated in the embodiment of the invention in FIG. 1A, the cross-sectional shape of the horizontal cross members is generally rectangular, and therefore, the tracks 30*a*,

30*b* are formed in a rectangular C-shape to receive the cross members 22*a*, 22*b*. The track engagement with the cross members prevents horizontal shifting of the seat when device 10 is in the high chair form and thus secures the seat within the support section 16. Device 10 preferably includes safety straps 32 which may be coupled together with an appropriate snap or other fastener such as hook and loop fasteners. The ends of the safety straps 32 are coupled to frame 12 by an appropriate fastener 36. When a toddler child is sitting in the high chair of FIG. 1, the safety straps 32 may be fastened about their legs and/or waist to further secure the child in the seat element of the high chair. To that end, apertures 40 are formed in the seat element 26 for passage of the safety straps 32. Furthermore, as illustrated in phantom in FIG. 1, seat element 26 might include a T-bar 27 across the front thereof for further retaining a child.

Seat element 26 is preferably formed of plastic and may be readily wiped clean. The seat element has a back 23, two sides 25 and a seat surface 27 for securing a toddler child placed therein. An annular flange 29 extends around a top edge of seat element 26 and engages the top edge 31 of frame 12 to further support the seat element. Annular flange 29 might be eliminated and the seat element 26 may be secured to support section 16 through the tracks 30*a*, 30*b* only. The back 23 is upright when seat element 26 is positioned in the support section for supporting a toddler child in an upright fashion.

In accordance with the principles of the present invention, the support section is configured for receiving an infant child carrier when the seat element is displaced therefrom, and the support section is operable for supporting an infant child carrier above a floor surface.

Referring to FIG. 2, seat element 26 is shown removed from the support section 16 and positioned on the frame 12 below the support section. Mounting elements 42 are positioned on the frame as illustrated in FIGS. 2 and 2A. In a preferred embodiment of the invention, the mounting elements are mounting knobs, such as wood or plastic knobs which are appropriately fastened to frame 12. Seat element 26 includes apertures formed therein for receiving the mounting knobs to secure the seat element to the frame below the support section. Mounting knobs 42 are positioned on both side elements 18*a*, 18*b* of the frame toward the front of the frame. Apertures 44 are formed in the seat element and specifically on the sides of the seat element and toward the front of the seat. To remove the seat element 26 from support section 16, the seat is lifted, such as by handle aperture 28 and is positioned below the support section 16 with the mounting knobs 42 fitting into the appropriately formed apertures 44. One of the mounting knobs 42*a* is positioned on cross member 22*b*. The handle aperture 28 receives mounting knob 42*a* for securing the seat element 26 to frame 12. As will be appreciated, an indentation or other opening (not shown) in the track 30*b* is necessary so that in the high chair form, as shown in FIGS. 1 and 1A, the track 30*b* can engage the cross member 22*b* which has mounting knob 42*a* positioned thereon.

Figure 2B:
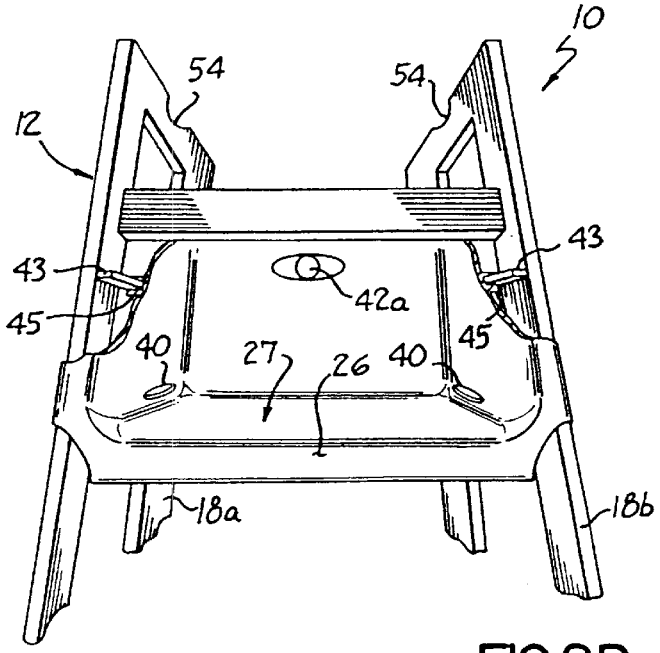
FIG. 2B is a front view similar to 2A showing an alternative means of securing the seat element of the device to the frame.

As illustrated in FIG. 2B, the frame 12 might alternatively include rails 43 in place of the knobs 42. The seat element 26 includes tracks 45 which are generally shaped and configured to engage the rails 43 to secure the seat element in position. Rails 43 might be short or could extend the entire depth of the frame. To convert the device, the seat element is removed from the support section and is slid onto rails 43.

Turning to FIGS. 2 and 2A, when seat element 26 is displaced and placed elsewhere or placed on the frame below the support section 16, the seat surface 27 is maintained generally horizontal to form a shelf for storing items, such as child care items. For example, a diaper bag or toys might be placed on the shelf when an infant carrier is positioned on frame 12 as illustrated in FIG. 3. The present invention provides a device which may be readily and easily changed between a high chair form and an infant carrier support form. Seat element 26 remains with frame 12 in either form, and thus is always available for such a conversion.

Support section 16 is essentially formed by upper portions of the vertical side members, as well as cross members 22*a*, 22*b*. Support section 16 is configured for receiving an infant child carrier 50 when the seat element 26 is displaced therefrom, and is operable for supporting an infant child carrier above a floor surface (see FIG. 3). An upper edge 52 of the support section 16 formed by the vertical side members 18*a*, 18*b* includes open portions, such as indentations 54 formed therein for receiving handle portions of an infant child carrier to secure the carrier to the support section 16 of frame 12. Infant carriers generally include a cradle-shaped base 56 with a pivoting handle 58 for carrying the base 56. The handles are generally coupled to base 56 and the sides thereof and thus the carrier is usually widest at the position of the handle. Furthermore, the point of attachment 60 and the pivot point for handle 58 is generally circular in cross-section. In accordance with the preferred embodiment, the indentations 54 are semicircular for receiving handle portion or pivot point 60 of carrier 50 to contain the handle. In that way, carrier 50 is effectively prevented from inadvertently sliding forward or backward on device 10. Alternatively, the upper edge of the vertical side members 18*a*, 18*b* may have open portions in the form of cutouts 55 (in phantom) for securing a carrier, rather than the indentations. The cross members 22*a*, 22*b* support bottom and/or side surfaces of the carrier 50 and thus provide additional support for the carrier from below. The safety straps 32 may also be secured across the top of the carrier to further hold the carrier to frame 12, and the straps are preferably dimensioned for such a task. As illustrated in FIG. 3, device 10 provides a safe support device for an infant carrier with a utility shelf formed below by the removed seat element 26.

Figure 4:
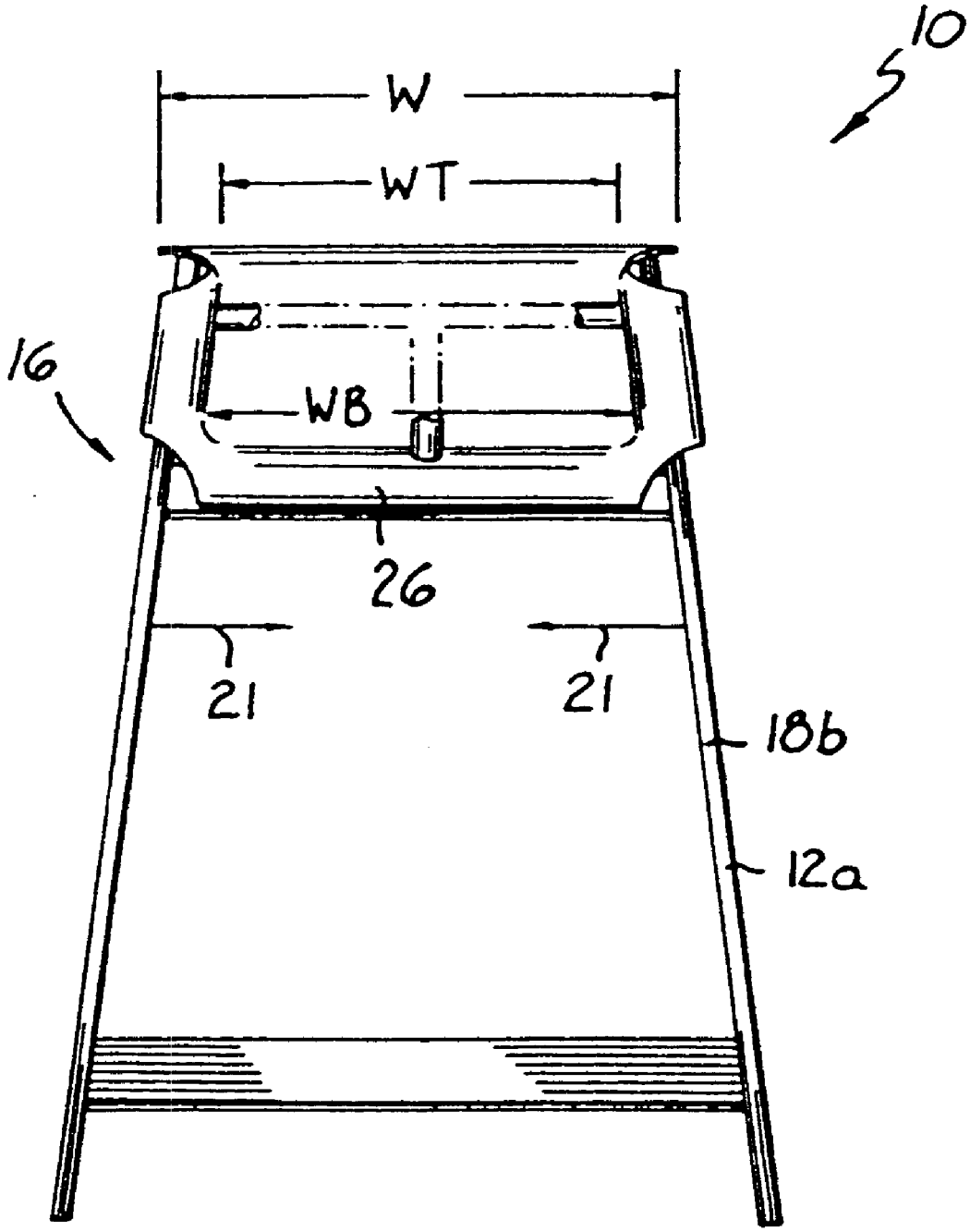
FIG. 4 is a front schematic view of the inventive device of FIG. 1.

For easy movement of seat element 26, the seat element is preferably dimensioned to be no wider at its base than at its top. Referring to FIG. 4, a schematic front view of the invention is shown wherein the inward tilt of the side members 18A is shown along lines 21. The support section 16 of frame 12 has its narrowest or minimum width W at the top thereof due to the inward tilt of the side members 18A. The seat element preferably has a base width $W_B$ which is no greater than the top width $W_T$. The maximum width $W_T$ of the top of seat element 26 is less than width W. In that way, the seat element 26 may be easily lifted, tilted, or slid out of the support section 16 without catching on a portion of the frame 12. Of course, base width $W_B$ might be larger than the top width $W_T$, and the seat element might be slid out from the front of the support section 16. However, the former described situation is desirable to provide more flexibility in manipulating the seat.

Figure 5:
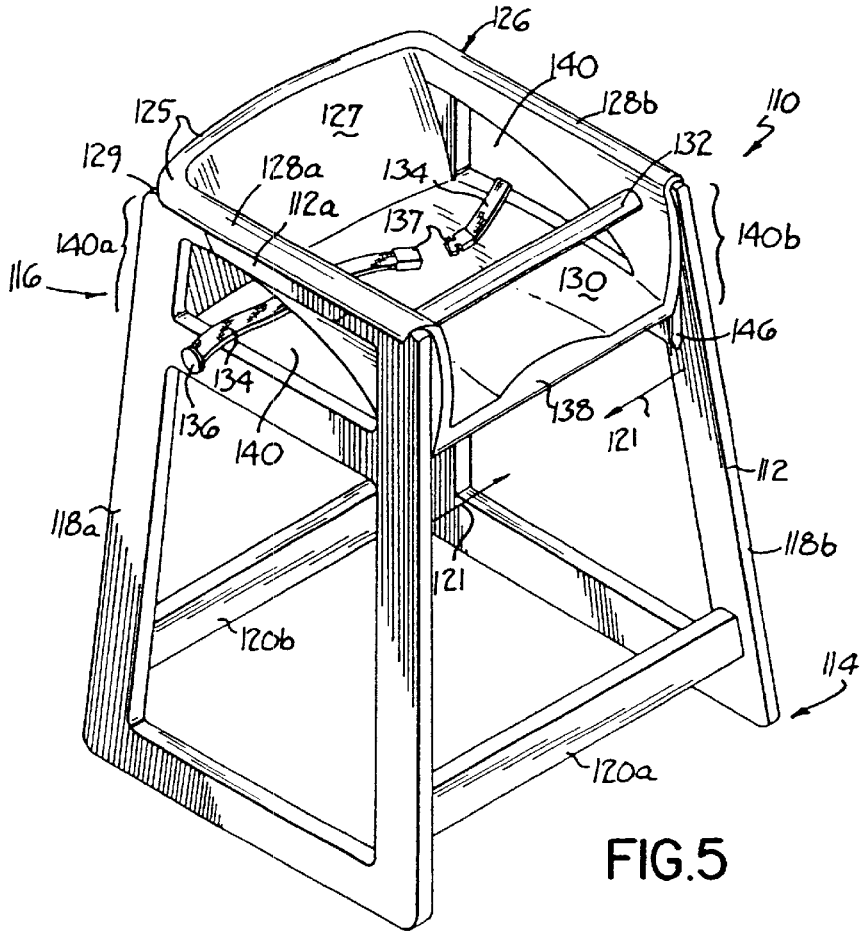
FIG. 5 is a perspective view of another embodiment of the inventive child support device.

FIG. 5 shows another embodiment of the child support device of the present invention in the toddler mode for supporting a toddler child. Child support device 110 includes a frame 112 having a base 114 and a support section 116 positioned above the base. Frame 112 includes two side members 118*a*, 118*b* which taper in their width dimension W from base 114 up to the support section 116. In the base of frame 114, horizontal cross members 120*a*, 120*b* extend between the two generally vertical side members 118*a*, 118*b*. The wide bottom portions of the side members 118*a*, 118*b* and the cross members 120*a*, 120*b* collectively form the base 114 of frame 112. The side members 118*a*, 118*b* taper inwardly proceeding from the base 114 to the support section 116 to have a generally triangular shape. Furthermore, as illustrated in FIG. 5, the side members are tilted inwardly in the direction of arrows 121 such that the cross-sectional dimension of the frame base 114 is larger than the cross-sectional dimension of the support section 116. In that way, the wide base 114 provides a suitable platform for supporting a child in the child support device 110. In support section 116, additional cross members 122*a*, 122*b* extend between the side members 118*a*, 118*b* for further securing the various members together to form the device frame 112. In a preferred embodiment of the invention, frame 112 is made of wood to give a warm and appealing appearance to a restaurant patron. The various frame elements may be held together by glue, nails, or any other suitable fastening structures.

In accordance with the principles of the present invention, device 110 further includes a seat element 126, which includes a back 127, two sides 128*a*, 128*b*, and a seat surface 130. The seat element is configured for receiving a toddler child (not shown) in an upright or sitting position. Seat element 126 might also include a cross-bar 132 to prevent the child from sliding forward and out of the seat element. As illustrated in FIG. 5, the seat element engages the support section 116 of frame 112 above the base and above a floor surface on which the base rests. In that way, the invention in the form illustrated in FIG. 5 forms a high chair for a toddler child. Preferably, seat element 126 is formed of a suitable plastic material which may be easily cleaned after each use. In a preferred embodiment, safety straps 134 are coupled to frame 112 by a suitable fastener 136. The safety straps may be wrapped around the waist and legs of a toddler child sitting in the seat element 126 to further secure the child in the high chair structure. To that end, the safety straps 134 include a buckle 137, or other suitable fastening structure, such as hook and loop fasteners, for coupling the two safety straps 34 together across the legs and/or waist of the child. The seat surface 130 of seat element 126 may be conformed to the seat and legs of a child, such as by placing a raised portion 138 in the seat surface 130. Suitable side openings 140 in the seat element 126 allow the safety straps 134 to extend inwardly to the seat surface 130 for securing the toddler child in the seat element 126.

Figure 6:
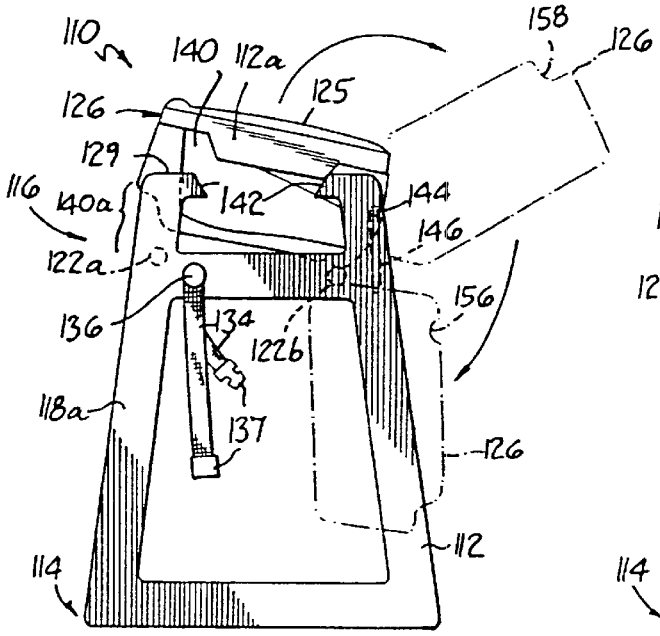
FIG. 6 is a side view of the inventive device of FIG. 5 showing removal of the seat element from the support section.
Figure 7:
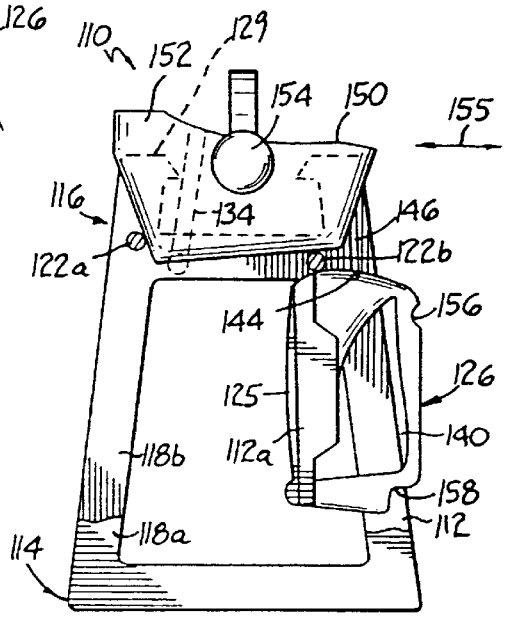
FIG. 7 is a side view of the device in FIG. 5 showing an infant carrier supported by the inventive device after removal of the seat element.

As seen in FIGS. 5, 6, and 7, seat element 126 has an upper annular flange 125 which sits on an upper edge 129 of the frame support section. The seat surface 130 rests on cross members 122*a*, 122*b*.

Turning to FIG. 6, seat element 126 includes portions 112*a* of the frame coupled thereto around the top edge of the seat element. Specifically, frame portions 112*a* are coupled to the side sections of the annular flange 127 as shown in FIG. 6. The seat element 126 is moveably mounted with respect to frame 112, as discussed further hereinbelow, and when the seat element 126 is engaged by the support section 116, as shown in FIG. 5, the support section 116 is configured to receive the frame portions 112*a* to form a completed frame 112.

Referring to FIG. 6, the vertical side members 118*a*, 118*b* include portions 140*a*, 140*b* which have an open upper end 142 provided by a cutout section of the side members 118*a*, 118*b*. The portions 140*a*, 140*b* could be characterized as U-shaped or C-shaped, depending upon how much of a cut-out section is provided. The portions 140*a*, 140*b* of the side members 118*a*, 118*b* form part of the support section 116 of the frame 112. When the seat element 126 is received by the support section 116, the frame portions 112*a* attached thereto are received by the U-shaped portions, generally at the upper end thereof, to close the open end 142 and provide a completed frame as shown in FIG. 5. The frame portions 112*a* which are secured to the seat element 126 such as by glue or appropriate fasteners (not shown), further align the seat element 126 within the support section 116 for a sturdy construction and for securing the seat element 126 to the frame 112. Additionally, when in the toddler mode or high chair form, as shown in FIGS. 5 and 6, the frame portions 112*a* interact with the portions 140*a*, 140*b* and provide the appearance of a solid frame structure.

Seat element 126 preferably includes suitable indentations 156, 158 on the bottom side of seat surface 130 which receive the cross members 122*a*, 122*b* when the seat element 126 is seated within support section 116 as illustrated in FIG. 6. In that way, the indentations further help to secure the seat element 126 within support section 116 so that the seat element does not slide around or rattle on the frame 112 of device 110.

In accordance with the principles of the present invention, the seat element is movably mounted to frame 112 so that the device 110 may be converted to the infant mode. More specifically, the seat element is pivotably mounted to the frame 112, and to that end includes a pivot axis 144 which engages an aperture 146 formed in the frame, and specifically, formed at a front end thereof on the inside of the side members 118*a*, 118*b*. As illustrated in FIG. 6, the seat element may be displaced by being pivoted on axis 144 out of and away from the support section 116, and more specifically, out of and away from the portions 140*a*, 140*b* of the side members 118*a*, 118*b*. Seat element 126 pivots at one end out of the support section and is suspended below the support section 116 by frame 112. In that way, the seat element is moved out of the way and the device 110 of the invention is now in a form for supporting an infant child carrier, as illustrated in FIG. 7. The pivot axis 144 in slot 146 suspends the seat element from frame 112.

In a preferred embodiment of the invention, aperture 146 is formed in the shape of an elongated slot such that the axis 144 of seat element 126 may not only pivot within the slot 146, but also slides down the length of the slot to its bottom-most end. In that way, as shown in FIG. 7, the seat element 126 may be moved completely out of the way of the support section 116 to hang below the support section so as not to hinder or obstruct the use of device 110 with an infant carrier 150. Axis 144 may be formed of metal or plastic or any suitable material which is rigid enough to support the weight of seat element 126 after it has been moved away from the support section 116 of frame 112. In the form as illustrated in FIG. 7, the portions 140*a*, 140*b* are exposed and the support section 116 is configured to receive an infant child carrier 150 to support the infant child carrier 150 and an infant therein above a floor surface on which base 114 rests. Infant child carriers 150, also commonly referred to as "pumpkin seats," generally include a cradle section 152 and a pivoting handle 154. The portions 140*a*, 140*b* of frame 112, and specifically the open upper ends 142 of the portions, accommodate the handle 154 to thereby contain the handle and prevent child carrier 150 from sliding forward and backward in the direction of arrow 155. The cross members 122*a*, 122*b* support the bottom and side surfaces of the infant child carrier 150 so that when placed in the device 110, the infant child carrier is generally in an upright position, as illustrated in FIG. 7. Finally, the side member portions 140*a*, 140*b* essentially prevent carrier 150 from sliding side-to-side in frame 112. Of course, slight movement of the carrier in a particular direction is acceptable as long as the carrier does not slide off of the frame.

If desired, the safety straps 134 might be wrapped around the infant child carrier to further secure it to device 110. To that end, the safety straps are dimensioned in length to do so. However, the weight of the infant child carrier 150 and infant is generally suitable for securely maintaining the carrier within the support section 116 of device 110.

While a preferred embodiment of the present invention utilizes portions 140*a*, 140*b* which have open upper ends 142 for accommodating the handle 154 of carrier 150, a support section without an open upper end might also be utilized wherein the top of the support section extends, unbroken, completely across the top of the frame, similar to the illustration in FIG. 5, without a separate frame portion 112*a* on the seat element 126. That is, the handle may simply rest on a top edge of the frame, rather than being received by and within the frame as illustrated in the figures.

Figure 8:
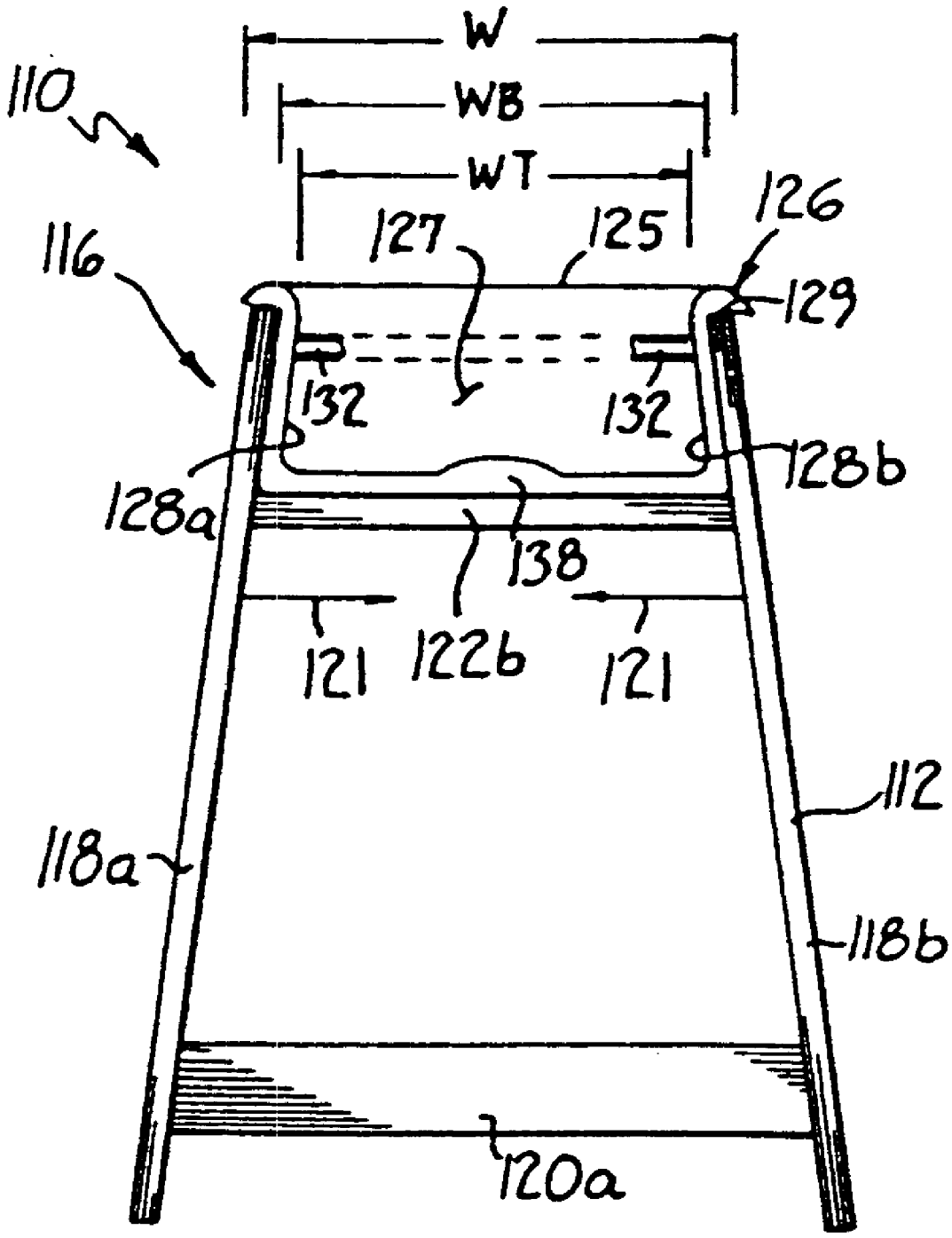
FIG. 8 is a front schematic view of the inventive device of FIG. 5.

For easy movement of seat element 126, the seat element is preferably dimensioned to be no wider at its base than at its top. Referring to FIG. 8, a schematic front view of the invention is shown wherein the inward tilt of the side members 118*a* is shown along lines 121. The support section 116 of frame 112 has its narrowest or minimum width W at the top thereof due to the inward tilt of the side members 118*a*. The seat element preferably has a base width $W_B$ which is no greater than the top width $W_T$. The maximum width $W_T$ of the top of seat element 26 is less than width W. In that way, the seat element 126 may be easily lifted, tilted or slid out of the support section 116 without catching on a portion of the frame 112.

Figure 9A:
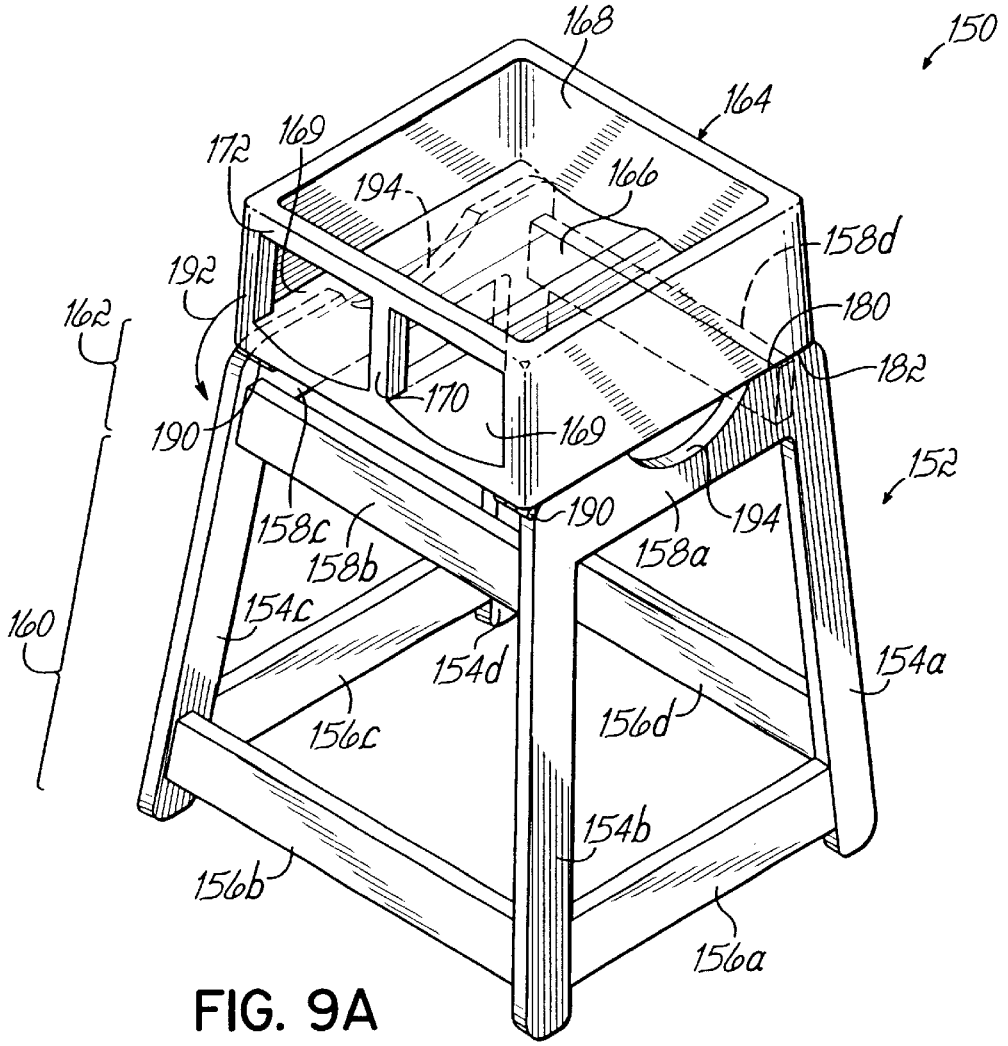
FIG. 9A is a perspective view of another embodiment of the invention showing the seat element in a first position.
Figure 9B:
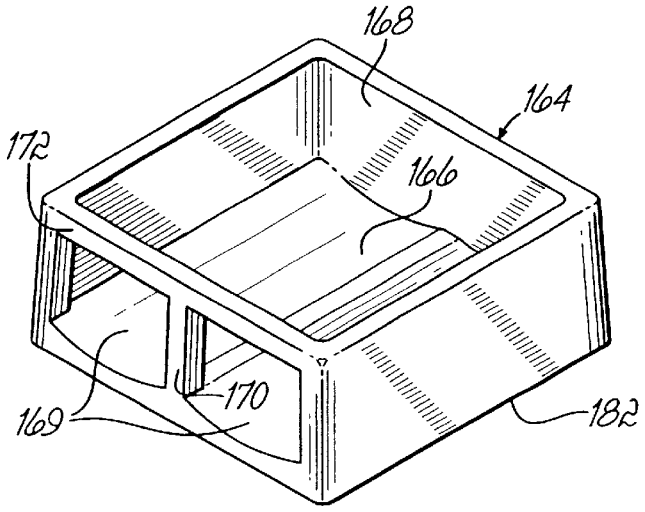
FIG. 9B is a perspective view of the seat element displaced from the support section in accordance with one embodiment of the invention.
Figure 10:
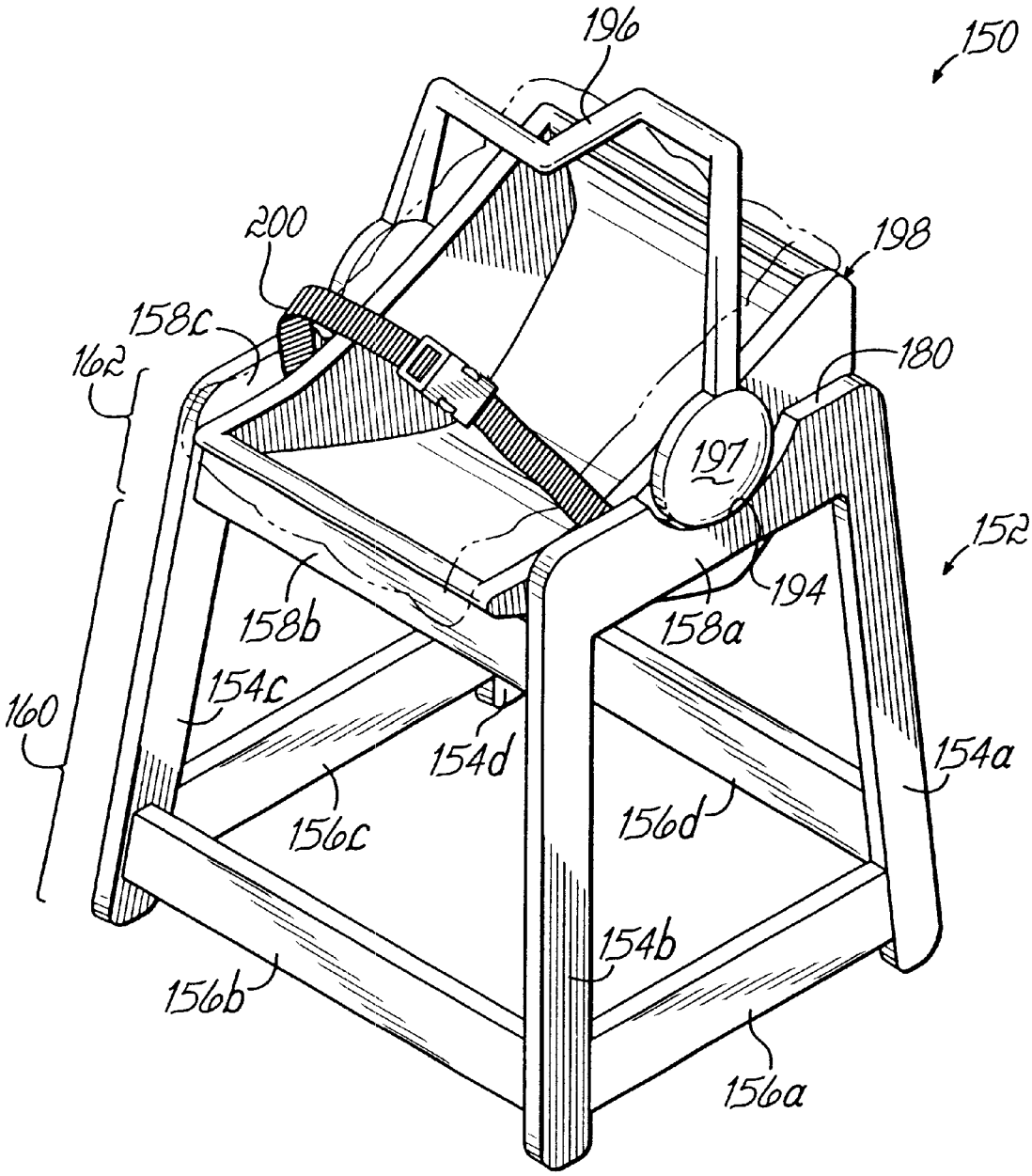
FIG. 10 is a perspective view of an embodiment of the invention wherein the seat element has been displaced and the support section is supporting a carrier.

FIGS. 9A, 9B and 10 disclose another embodiment of the present invention. Device 150 is a multi-purpose child support device which may be selectively utilized for supporting a toddler child or an infant child in the child carrier. The device 150 includes a frame 152. The frame may be formed of wood, plastic, or some other suitable material. Frame 152 shown in the embodiment shown in FIGS. 9A, 9B, and 10, has a generally rectangular cross-sectional shape and includes four generally vertical corner posts 154*a*, 154*b*, 154*c*, and 154*d*. Horizontal members 156*a*, 156*b*, 156*c*, and 156*d* extend between the corner posts 154*a*–154*d* proximate the bottom of the frame. Similarly, horizontal members 158*a*–158*d* extend between the vertical corner posts proximate the top of the frame 152. Therefore, the frame 152 has a generally box-like shape.

The frame and its various elements form a base section 160 which is defined generally as the lower section of the frame. The base section 160 is configured for placement on a floor surface.

The frame also includes a support section 162 which is generally formed by the upper section of the frame. The support section, as discussed further hereinbelow, is utilized to support a seat element 164. The reference brackets illustrating the base section 160 and support section 162 are for illustrative purposes and do not limit the frame to a specific size, dimension or construction. Furthermore, the relative size of the section is not limited by the reference brackets, and the support section may be longer or taller than what is designated as the base section.

As will be readily understood by a person of ordinary skill in the art, the specific structure of the frame, including the base section and support section are not limited to the specific structures shown and disclosed herein. Rather, other frames might be utilized, along with other seat elements for practicing the present invention as disclosed and claimed herein.

Referring to FIG. 9A, when the base section is positioned on a floor surface, the support section is elevated above the floor surface. The seat element 164 engages the frame and is supported thereby for forming a high chair as shown.

Referring to FIG. 9B, the seat element 164 has a seat surface 166 and a back 168. The seat element 166 is configured for supporting a toddler child, generally in a sitting position, as is conventional in a high chair. Openings 169 are provided for the legs of the child, and the openings may be separated by a divider 170 which terminates in a cross bar 172 for containing the legs of the child and thus containing the child within the seat element, such as during dining.

In accordance with one aspect of the present invention, the support section 162 includes an upper edge 180 which is configured for engaging the seat element 164, and particularly for engaging a lower edge 182 of the seat element. When the support section engages the seat element, it supports the seat element in a first position as shown in FIG. 9A, generally above the support section of the frame so that the device forms a high chair structure. That is, the seat element 164 sits generally on top of the support section 162. The seat element is movably mounted to frame 152, and is movable to a second position which is displaced from the support section 162 by disengaging and/or separating the lower edge of the seat element from the support section upper edge. FIG. 9A illustrates the device with the seat element in the first position so that the device forms a high chair.

In one embodiment of the invention, the seat element is configured to be removed completely from the frame when in the second position. Specifically, seat element 164 would be removed from frame 152, and would thereby exist as a separate piece, as shown in FIG. 9B. The seat element would then have to be stored or positioned elsewhere when the device 150 is used to support an infant in a carrier. The separate seat element 164, for example, might be used as a booster seat for a toddler in a regular chair. To attach the seat element to the frame, in the first position, various physical structures might be used as discussed further hereinbelow. In an alternative embodiment of the invention, the seat element is pivotally coupled to the support section. As illustrated in FIG. 9A, the seat element may be pivotally coupled to frame 152 and specifically to the support section 162 of the frame at pivot points 190. For example, the pivot points 190 might be hinges. To move the seat element 164 to the second position, it is pivoted as illustrated by arrow 192 about the pivot points 190 and will generally rest against a side of the frame. Alternatively, the pivot points for the seat element and the frame might be configured such that the seat element 164 might be pivoted to a second position within the frame, rather than along the side of the frame. As will be understood by a person of ordinary skill in the art, various means might be utilized to pivotally couple the seat element to frame 152, and specifically to the support section 162 of the frame.

The seat element 164 is thereby movable to a second position which is displaced from the support section. When the seat element is in the second position, the upper edge of the frame 180, which coincides with the upper edge of the support section in the disclosed embodiment, is exposed. The support section 162 is configured for receiving an infant child carrier. In the embodiment illustrated in FIGS. 9A and 10, the upper edge 180 of the support section is formed to engage the infant child carrier to prevent it from sliding off of the frame. Specifically, in the embodiment illustrated in the Figures, the upper edge 180 of the support section includes indents for engaging a portion of the infant child carrier to prevent it from sliding off of the frame. Referring to FIG. 10, the indents 194 are shown engaging a handle 196 of an infant child carrier 198. The indents 194 are shown as rounded in the figures, but may take any appropriate shape for engaging a portion of existing infant child carriers. Many infant child carrier designs currently utilize handles having generally rounded attachment points 197 as shown in FIG. 10. In fact, the handle 196 of an infant child carrier generally pivots about the main body of the carrier at the rounded attachment points 197. In that way, the handle can be pivoted to a vertical position, as illustrated in FIG. 10, for carrying the carrier and positioning it on frame 152, and then can be pivoted out of the way to allow an unobstructed view of, or access to, the baby. For further securement, a strap 200 might be coupled to the frame for securing the infant child carrier to the frame 152 when it is positioned thereon, as shown in FIG. 10.

The upper edge 180 of the frame, which is formed to engage the infant child carrier, to support it, and to prevent it from sliding off of the frame, is defined by the components which make up the frame. In the embodiment illustrated in FIGS. 9A and 9B, the upper edge 180 is defined by the various horizontal members 158*a*–158*d*, and the upper edges thereof. With the upper edge 180 of the frame defined as illustrated in the drawings, the infant child carrier 198 is supported on both the front and back and on the sides by that edge, as seen in FIG. 10. Alternatively, certain portions of the support section of the frame, such as the portions defined by the horizontal members 158*b* and 158*d* might sit below members 158*a*, 158*c*. As such, only the upper edges of the portion of the frame defined by horizontal members 158*a* and 158*c* may engage and support the seat element and/or engage and support the infant child carrier and prevent it from sliding from the frame. Generally, it will be necessary to engage one of the front and back of the carrier, or both the front and back, while the carrier is supported on the frame. In that way, the carrier cannot rotate about the points 197.

Figure 11:
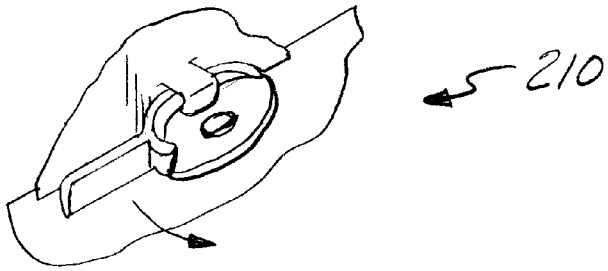
FIG. 11 is a perspective view of an embodiment of the invention.
Figure 12:
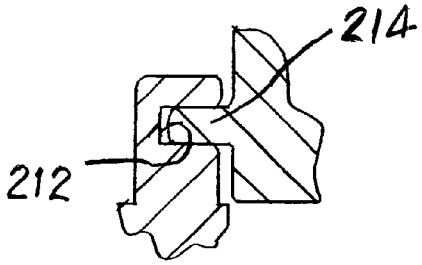
FIG. 12 is a perspective view of an embodiment of the invention.

To form the high chair as illustrated in FIG. 9A, the seat element will generally be secured to the frame, and specifically to the support section, such that the edges 180, 182 engage each other. Various different structures might be utilized for securing the seat element to the frame. Specifically, a hasp structure 210, as shown in FIG. 11, may be coupled between the seat element and the support section, and specifically between the lower edge of the seat element and the upper edge of the support section. The hasp structure would be operable for securing the seat element in the first position. Similarly, one of a groove and track might be positioned on the frame while the other of the groove in a track might be positioned on the seat element. The groove and track would be operable for engaging each other for securing the seat element in the first position. (See FIG. 12.) For example, one of the groove 212 and track 214 might be positioned proximate the upper edge of the support section, and the other of the groove and track might be positioned proximate the lower edge of the seat element. In that way, the seat element could be slid into the frame and held thereto.

Figure 13:
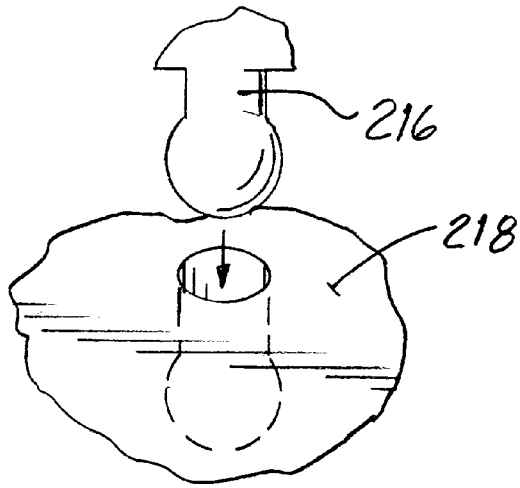
FIG. 13 is a perspective view of an embodiment of the invention.

In still another embodiment, a male coupling and a female coupling might be utilized between the seat element and frame. (See FIG. 13.) For example, one of the couplings could be positioned proximate the upper edge of the support section, while the other coupling is positioned proximate the lower edge of the seat element. The male coupling 216 is operable for engaging the female coupling 218 and thereby securing the seat element in the first position, as shown in FIG. 9A. For example, pins on one of the frame and seat elements, and corresponding holes in the other, might be used to secure the seat element to the frame. As may be appreciated, other securement means might be utilized for securing the seat element on the frame in the first position, as shown in FIG. 9A.

The inventive device 110 thus provides a child support device which may accommodate children of all ages, including infant children within a carrier and toddler children. Restaurants only have to purchase one device to accommodate all children and thus do not have to maintain separate infant carrier structures as well as traditional high chairs. The inventive device provides a safe and secure place for children during dining. Furthermore, the inventive device, in the infant carrier form, may be utilized for supporting an infant carrier while parents wait to be seated at a table. This eliminates the need for a parent to hold the heavy infant carrier for a long period of time, or to place the infant carrier on a cold and dirty ground surface. Still further, the dual function of the invention conserves a substantial amount of valuable restaurant space which is usually dedicated to separate high chair and separate infant carrier support structures. The invention safely and securely supports an infant carrier and eliminates the need for a restaurant customer to dangerously flip a traditional high chair structure to place the infant carrier in the wide base thereof. As such, the present invention will limit the liability exposure of restaurants.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A multi-purpose child support device for selectively supporting a toddler child or an infant child in a child carrier, the device comprising:

a frame including a base section and a support section positioned above the base section, the base section configured for placement on a floor surface;

a seat element having a seat surface and a back, the seat element configured for supporting a toddler child generally in an upright sitting position;

the support section having an upper edge configured for engaging a lower edge of the seat element to support the seat element in a first position generally above the support section of the frame so that the device forms a high chair for a toddler child;

the seat element being movably mounted to the frame and being movable to a second position displaced from the support section by disengaging the lower edge of the seat element from the support section upper edge;

the support section being further configured for receiving an infant child carrier with the seat element in the second position, the upper edge of the support section comprising at least one indent extending in a direction below the upper edge and configured to engage the infant child carrier to restrict movement of the child carrier on the upper edge and thereby prevent it from sliding off of the frame.

2. The child support device of claim 1 further comprising a hasp structure coupled between the seat element lower edge and the upper edge of the support section, the hasp structure operable for securing the seat element in the first position with the support section upper edge engaging the seat element.

3. The child support device of claim 1 further comprising one of a groove and a track positioned proximate the upper edge of the support section and the other of the groove and track positioned proximate the lower edge of the seat element, the track operable for engaging the groove for securing the seat element in the first position.

4. The child support device of claim 1 further comprising one of a male coupling and a female coupling positioned proximate the upper edge of the support section and the other of the male and female couplings positioned proximate the lower edge of the seat element, the male coupling operable for engaging the female coupling for securing the seat element in the first position.

5. The child support device of claim 1 wherein said seat element is pivotally coupled to the support section proximate the engaging edges of the support section, the seat element being pivoted away from the support section in the second position.

6. The child support device of claim 1 wherein said seat element is configured to be removed completely from the frame when in the second position.

7. The child support device of claim 1 further comprising a strap coupled to the frame for securing the infant child carrier to the frame.

* * * * *